US007950543B2

(12) United States Patent
Yang et al.

(10) Patent No.: US 7,950,543 B2
(45) Date of Patent: May 31, 2011

(54) TRASH CAN ASSEMBLY WITH LOCKING LID

(75) Inventors: Frank Yang, Rancho Palos Verdes, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 939 days.

(21) Appl. No.: 11/134,107

(22) Filed: May 20, 2005

(65) Prior Publication Data

US 2006/0261071 A1 Nov. 23, 2006

(51) Int. Cl.
*B65D 43/14* (2006.01)

(52) U.S. Cl. ..... 220/324; 220/212.5; 220/323; 220/835; 220/908

(58) Field of Classification Search ..... 220/212.5, 220/323, 324, 908, 835
See application file for complete search history.

(56) References Cited

U.S. PATENT DOCUMENTS

| | | | | |
|---|---|---|---|---|
| 1,426,211 | A * | 8/1922 | Pausin | 220/212.5 |
| 1,820,555 | A | 8/1931 | Buschman | |
| 1,891,651 | A | 12/1932 | Padelford et al. | |
| 1,980,938 | A | 11/1934 | Geibel | |
| 2,759,625 | A | 8/1956 | Ritter | |
| 2,888,307 | A | 5/1959 | Graves et al. | |
| 2,946,474 | A | 7/1960 | Knapp | |
| 3,008,604 | A | 11/1961 | Garner | |
| 3,023,922 | A | 3/1962 | Arrington et al. | |
| 3,654,534 | A | 4/1972 | Fischer | |
| 3,891,115 | A | 6/1975 | Ono | |
| 4,014,457 | A | 3/1977 | Hodge | |
| 4,081,105 | A | 3/1978 | Dagonnet et al. | |
| 4,200,197 | A | 4/1980 | Meyer et al. | |
| 4,303,174 | A | 12/1981 | Anderson | |
| 4,320,851 | A * | 3/1982 | Montoya | 220/324 |
| 4,416,197 | A * | 11/1983 | Kehl | 100/214 |
| D284,320 | S | 6/1986 | Kubic et al. | |
| 4,630,332 | A | 12/1986 | Bisbing | |
| 4,711,161 | A | 12/1987 | Swin et al. | |
| 4,753,367 | A | 6/1988 | Miller et al. | |
| 4,765,548 | A | 8/1988 | Sing | |
| 4,765,579 | A | 8/1988 | Robbins et al. | |
| 4,792,039 | A | 12/1988 | Dayton | |
| 4,913,308 | A | 4/1990 | Culbertson | |
| 4,918,568 | A | 4/1990 | Stone et al. | |
| 4,948,004 | A | 8/1990 | Chich | |

(Continued)

FOREIGN PATENT DOCUMENTS

AU 622536 4/1992

(Continued)

OTHER PUBLICATIONS

European Search Report for European Application No. EP 06010394, dated Aug. 27, 2006, in 1 page.

(Continued)

*Primary Examiner* — Anthony Stashick
*Assistant Examiner* — Elizabeth Volz
(74) *Attorney, Agent, or Firm* — Knobbe, Martens, Olson & Bear LLP

(57) ABSTRACT

A trash can assembly has a shell and a lid fitted over the top end of the shell. The lid has a slidable lock member that is removably engaged to a portion of the shell to prevent the lid from being opened.

17 Claims, 5 Drawing Sheets

U.S. PATENT DOCUMENTS

| | | | | |
|---|---|---|---|---|
| 4,972,966 | A | | 11/1990 | Craft, Jr. |
| 5,065,272 | A | | 11/1991 | Owen et al. |
| 5,090,785 | A | | 2/1992 | Stamp |
| 5,111,958 | A | | 5/1992 | Witthoeft |
| D327,760 | S | | 7/1992 | Donnelly |
| 5,147,055 | A | | 9/1992 | Sampson et al. |
| 5,170,904 | A | | 12/1992 | Neuhaus |
| 5,174,462 | A | | 12/1992 | Hames |
| 5,213,272 | A | | 5/1993 | Gallagher et al. |
| 5,226,558 | A | | 7/1993 | Whitney et al. |
| 5,230,525 | A | | 7/1993 | Delmerico et al. |
| D340,333 | S | | 10/1993 | Duran et al. |
| 5,249,693 | A | | 10/1993 | Gillispie et al. |
| 5,322,179 | A | | 6/1994 | Ting |
| 5,348,222 | A | | 9/1994 | Patey |
| 5,385,258 | A | | 1/1995 | Sutherlin |
| 5,390,818 | A | | 2/1995 | LaBuda |
| 5,407,089 | A | | 4/1995 | Bird et al. |
| 5,471,708 | A | | 12/1995 | Lynch |
| 5,474,201 | A | | 12/1995 | Liu |
| 5,531,348 | A | | 7/1996 | Baker et al. |
| 5,558,254 | A | | 9/1996 | Anderson et al. |
| D377,554 | S | | 1/1997 | Adriaansen |
| 5,662,235 | A | | 9/1997 | Nieto |
| 5,699,929 | A | | 12/1997 | Ouno |
| 5,799,909 | A | | 9/1998 | Ziegler |
| 5,816,640 | A | * | 10/1998 | Nishimura ..... 296/37.8 |
| 5,881,896 | A | | 3/1999 | Presnell et al. |
| 5,967,392 | A | | 10/1999 | Niemi et al. |
| 6,000,569 | A | | 12/1999 | Liu |
| 6,010,024 | A | | 1/2000 | Wang |
| 6,024,238 | A | | 2/2000 | Jaros |
| 6,036,050 | A | | 3/2000 | Ruane |
| D435,951 | S | | 1/2001 | Yang et al. |
| 6,209,744 | B1 | | 4/2001 | Gill |
| 6,250,492 | B1 | | 6/2001 | Verbeek |
| 6,328,320 | B1 | | 12/2001 | Walski et al. |
| 6,364,147 | B1 | | 4/2002 | Meinzinger et al. |
| 6,386,386 | B1 | | 5/2002 | George |
| 6,390,321 | B1 | | 5/2002 | Wang |
| 6,401,958 | B1 | | 6/2002 | Foss et al. |
| 6,626,316 | B2 | | 9/2003 | Yang |
| 6,626,317 | B2 | | 9/2003 | Pfiefer et al. |
| D488,604 | S | | 4/2004 | Yang et al. |
| D489,857 | S | | 5/2004 | Yang et al. |
| D490,583 | S | | 5/2004 | Yang et al. |
| D490,954 | S | | 6/2004 | Brand |
| D491,706 | S | | 6/2004 | Yang et al. |
| D493,930 | S | | 8/2004 | Wang |
| D494,723 | S | | 8/2004 | Lin |
| 6,837,393 | B1 | | 1/2005 | Kuo |
| 6,883,676 | B2 | | 4/2005 | Lin |
| D507,090 | S | | 7/2005 | Yang et al. |
| 6,920,994 | B2 | | 7/2005 | Lin |
| 6,981,606 | B2 | | 1/2006 | Yang et al. |
| D517,764 | S | | 3/2006 | Wang |
| D518,266 | S | | 3/2006 | Yang et al. |
| 7,017,773 | B2 | | 3/2006 | Gruber et al. |
| D525,756 | S | | 7/2006 | Yang et al. |
| 7,077,283 | B2 | | 7/2006 | Yang et al. |
| 7,086,550 | B2 | | 8/2006 | Yang et al. |
| 7,121,421 | B2 | | 10/2006 | Yang et al. |
| D535,800 | S | | 1/2007 | Yang et al. |
| D537,223 | S | | 2/2007 | Lin |
| D537,599 | S | | 2/2007 | Lin |
| D537,601 | S | | 2/2007 | Lin |
| D538,995 | S | | 3/2007 | Lin |
| D539,499 | S | | 3/2007 | Yang et al. |
| D542,001 | S | | 5/2007 | Yang et al |
| D544,170 | S | | 6/2007 | Lin |
| D544,171 | S | | 6/2007 | Lin |
| D545,024 | S | | 6/2007 | Liao |
| D547,020 | S | | 7/2007 | Chen |
| D552,823 | S | | 10/2007 | Yang et al. |
| D552,825 | S | | 10/2007 | Yang et al. |
| 7,494,021 | B2 | | 2/2009 | Yang et al. |
| D615,722 | S | | 5/2010 | Yang et al. |
| 2002/0079315 | A1 | * | 6/2002 | Yang ..... 220/263 |
| 2003/0201267 | A1 | | 10/2003 | Yang et al. |
| 2004/0164077 | A1 | | 8/2004 | Kuo |
| 2005/0103788 | A1 | | 5/2005 | Yang et al. |
| 2006/0226149 | A1 | | 10/2006 | Yang et al. |
| 2006/0249510 | A1 | | 11/2006 | Lin |
| 2006/0261071 | A1 | | 11/2006 | Yang et al. |
| 2007/0012699 | A1 | | 1/2007 | Yang |
| 2008/0237234 | A1 | | 10/2008 | Yang et al. |
| 2010/0224627 | A1 | | 9/2010 | Yang et al. |
| 2010/0237074 | A1 | | 9/2010 | Yang et al. |

FOREIGN PATENT DOCUMENTS

| | | |
|---|---|---|
| DE | 1610087 | 7/1950 |
| DE | 1283741 | 7/1966 |
| DE | 84 36 939 | 3/1985 |
| DE | 9108341 | 10/1991 |
| DE | 29918687 | 3/2000 |
| DE | 19933180 | 1/2001 |
| EP | 1 136 393 | 5/2000 |
| EP | 1 094 017 | 10/2000 |
| EP | 1 361 176 | 11/2003 |
| JP | 02-152670 | 6/1990 |
| JP | 06-272888 | 9/1994 |
| NL | 6908550 | 12/1970 |
| WO | WO92/02430 | 2/1992 |

OTHER PUBLICATIONS

Partial European Search Report for Application No. EP 10002273, dated Jul. 2, 2010, in 4 pages.

Trento Corner 23 Trash Can, Hailo product brochure, http://www.hailo.de/html/default.asp?site=12_71_107&lang=en.

* cited by examiner

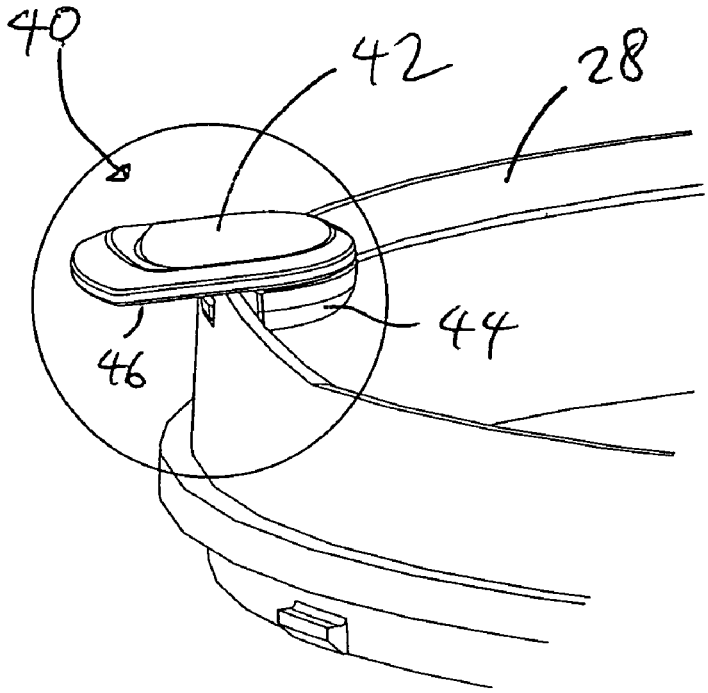
FIG. 5A
FIG. 5B
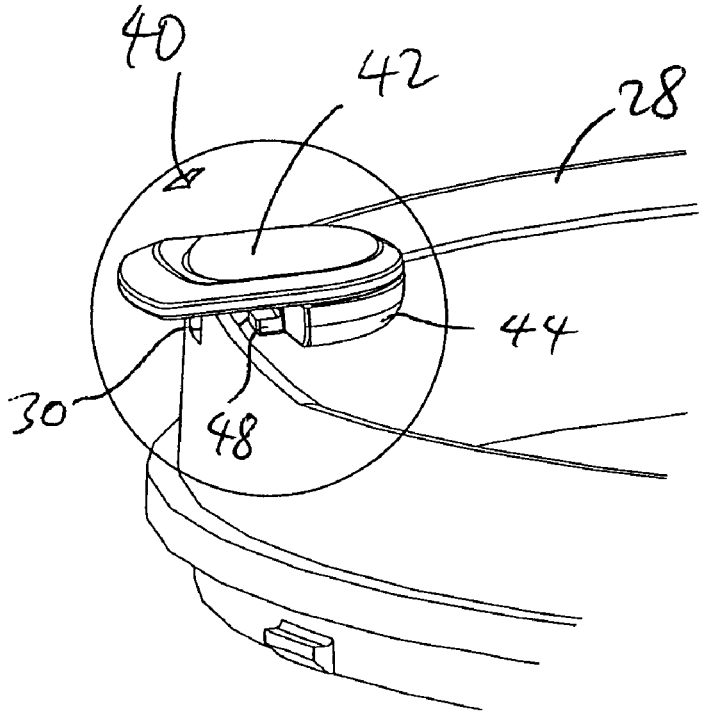

TRASH CAN ASSEMBLY WITH LOCKING LID

BACKGROUND OF THE INVENTION

1. Field of the Invention

The present invention relates to household items, and in particular, to a trash can assembly having a lid that can be locked to prevent the lid from being opened.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to toss trash, or to change the plastic liner or bag that is used to line the trash can.

Unfortunately, the lid can be opened inadvertently by stepping on the pedal, or by lifting the lid. There are times when it is desirable to merely lock the lid so that the lid cannot be opened. For example, the trash can may be holding dangerous or pungent waste matter, and the user may decide that the lid should be locked so that children cannot access the waste matter inside the trash can. As another example, homes that have pets running around may find it desirable to prevent the lid from opening, since these pets may inadvertently tip over a trash can.

Thus, there remains a need for a trash can whose lid can be locked to prevent the lid from being opened.

SUMMARY OF THE DISCLOSURE

It is an object of the present invention to provide a trash can assembly having a lid that can be locked.

In order to accomplish the objects of the present invention, there is provided a trash can assembly that has a shell and a lid fitted over the top end of the shell. The lid has a slidable lock member that is removably engaged to a portion of the shell to prevent the lid from being opened.

BRIEF DESCRIPTION OF THE DRAWINGS

FIG. 5A is an enlarged perspective view of the lock member and the upper support frame of the trash can assembly of FIG. 1 shown with the lock member in the locked position.

FIG. 5B is an enlarged perspective view of the lock member and the upper support frame of the trash can assembly of FIG. 1 shown with the lock member in the unlocked position.

DETAILED DESCRIPTION OF THE PREFERRED EMBODIMENTS

Figure 2:
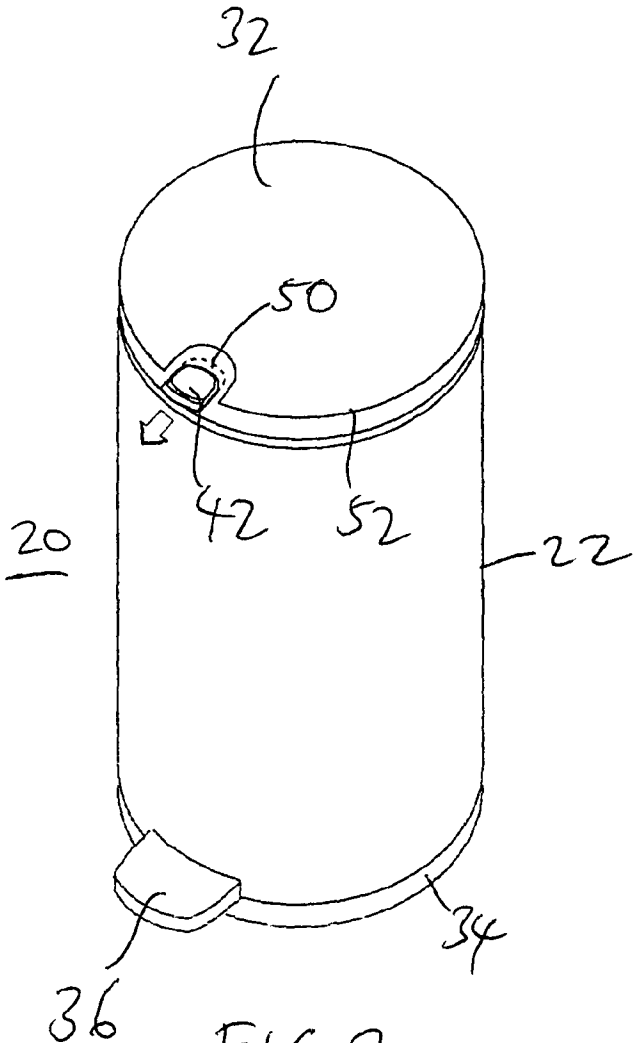
FIG. 2 is a perspective view of the trash can assembly of FIG. 1 shown with the lid unlocked.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1-7 illustrate one embodiment of a trash can assembly 20 according to the present invention. The assembly 20 has a shell 22 and an internal liner (not shown) that is adapted to be retained inside the shell 22. The shell 22 can be made from either plastic or metal. The liner is essentially a container, and can also be made from either plastic or metal. The shell 22 is an enclosing wall which can have any desired shape, including oval, triangular, rectangular, square or circular (among others). The liner can have the same shape as the shell 22. An upper support frame 28 can be secured to the opened top of the shell 22, and can be provided in a separate material (e.g., plastic if the shell 22 is metal) from the shell 22.

A lid 32 is hingedly connected to the upper support frame 28 using hinged connections that are well-known in the art, and will not be described in greater detail herein. As one non-limiting example, the lid 32 can be hingedly connected to the shell 22 in the manner that is described in U.S. Pat. No. 6,626,316, whose entire disclosure is incorporated by this reference as though set forth fully herein. The shell 22 and its lid 32 can be made of a solid and stable material, such as a metal. The shell 22 has a base 34, and a foot pedal 36 is pivotably secured to the base 34.

A link assembly extends from the foot pedal 36 along the base 34 and then upwardly along the rear of the shell 22 to the upper support frame 28 and the lid 32. The link assembly operates to translate an up-down pivot motion of the pedal 36 to a corresponding up-down pivot motion for the lid 32. The construction and operation of link assemblies are well-known in the art, and will not be described in greater detail herein. As one non-limiting example, the link assembly, foot pedal 36 and lid 32 can be constructed in accordance with that which is described in U.S. Pat. No. 6,626,316, whose entire disclosure is incorporated by this reference as though set forth fully herein.

Figure 1:
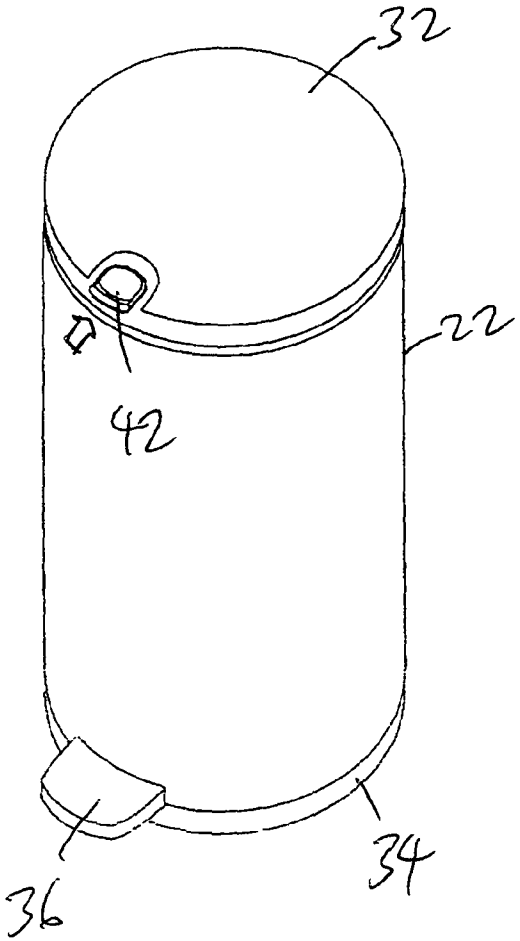
FIG. 1 is a perspective view of a trash can assembly according to one embodiment of the present invention shown with the lid locked.
Figure 7:
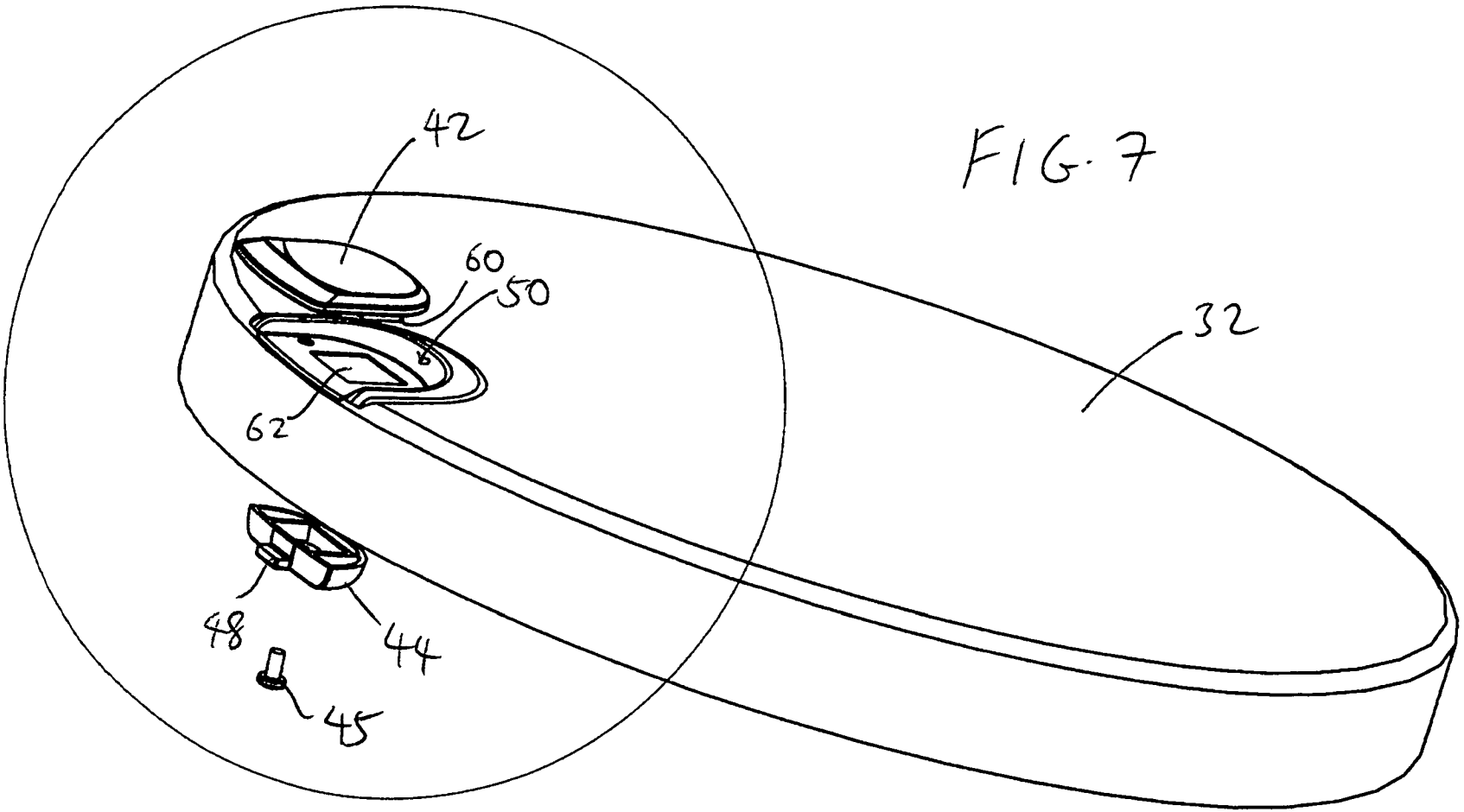
FIG. 7 is exploded perspective view of the lid of the trash can assembly of FIG. 1 showing the separate components of the lock member.

A lock member 40 is provided on the lid 32, and cooperates with the upper frame member 28 to lock the lid 32, thereby preventing the lid 32 from being opened. As best shown in FIGS. 4A-4B, 5A-5B, 6 and 7, the lock member 40 has a slide member 42 and a base member 44 that is secured to a portion (e.g., about half) of the lower surface 46 of the slide member 42 by a screw 45. A tongue 48 extends from the base member 44 in a direction facing the lower surface 46 of the slide member 42. As best shown in FIGS. 1, 2 and 7, the slide member 42 is seated in a depression 50 provided along the edge 52 of the lid 32 near the front of the lid 32. The slide member 42 has a guide ridge 60 extending from its lower surface 46, with the guide ridge 60 extending through an opening 62 provided in the depression 50 of the lid 32 to be secured to the base member 44. The opening 62 is larger than the guide ridge 60 to facilitate the reciprocal sliding motion of the lock member 40 described below.

Figure 4A:
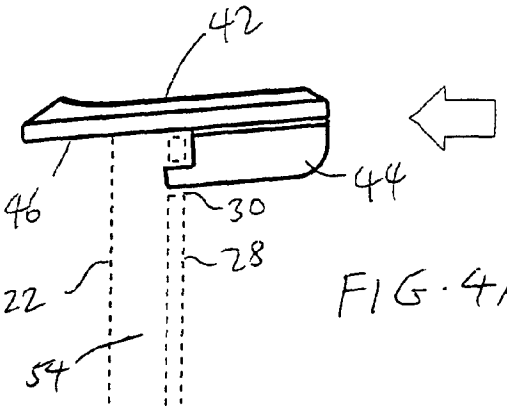
FIG. 4A is a sectional side plan view of the lock member and the upper support frame of the trash can assembly of FIG. 1 shown with the lock member in the locked position.
Figure 4B:
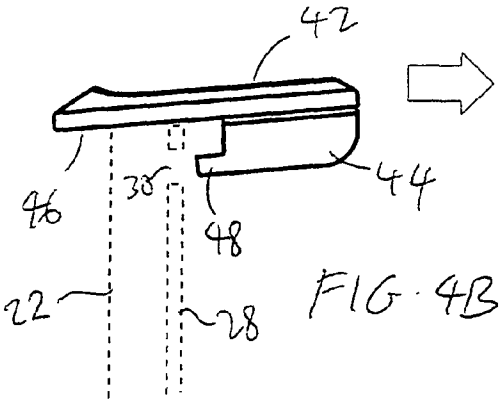
FIG. 4B is a sectional side plan view of the lock member and the upper support frame of the trash can assembly of FIG. 1 shown with the lock member in the unlocked position.
Figure 3:
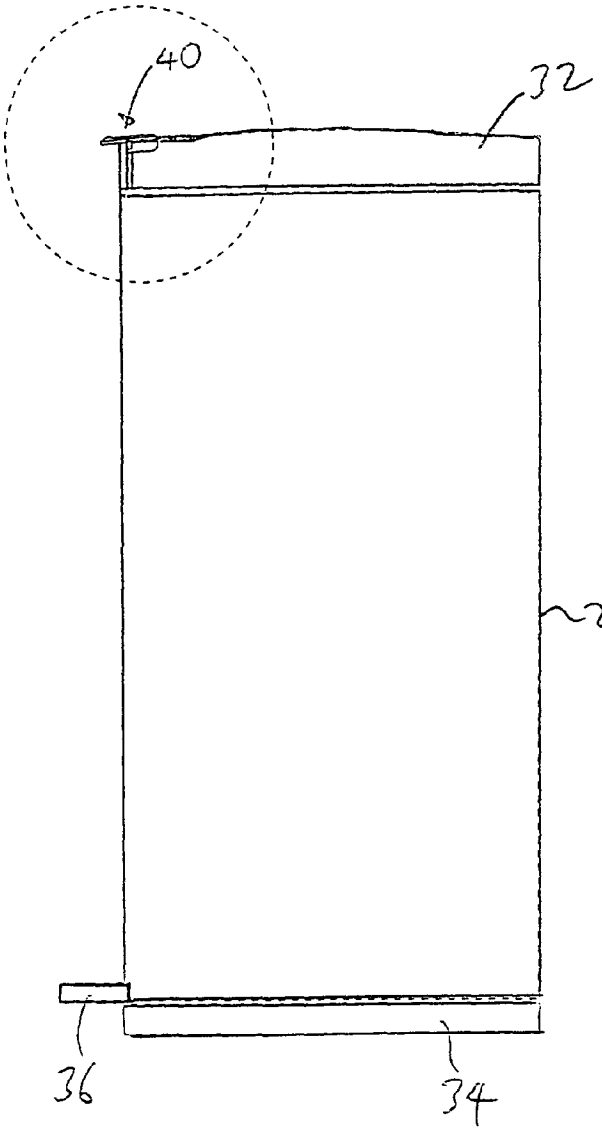
FIG. 3 is a side plan view of the trash can assembly of FIG. 1.
Figure 6:
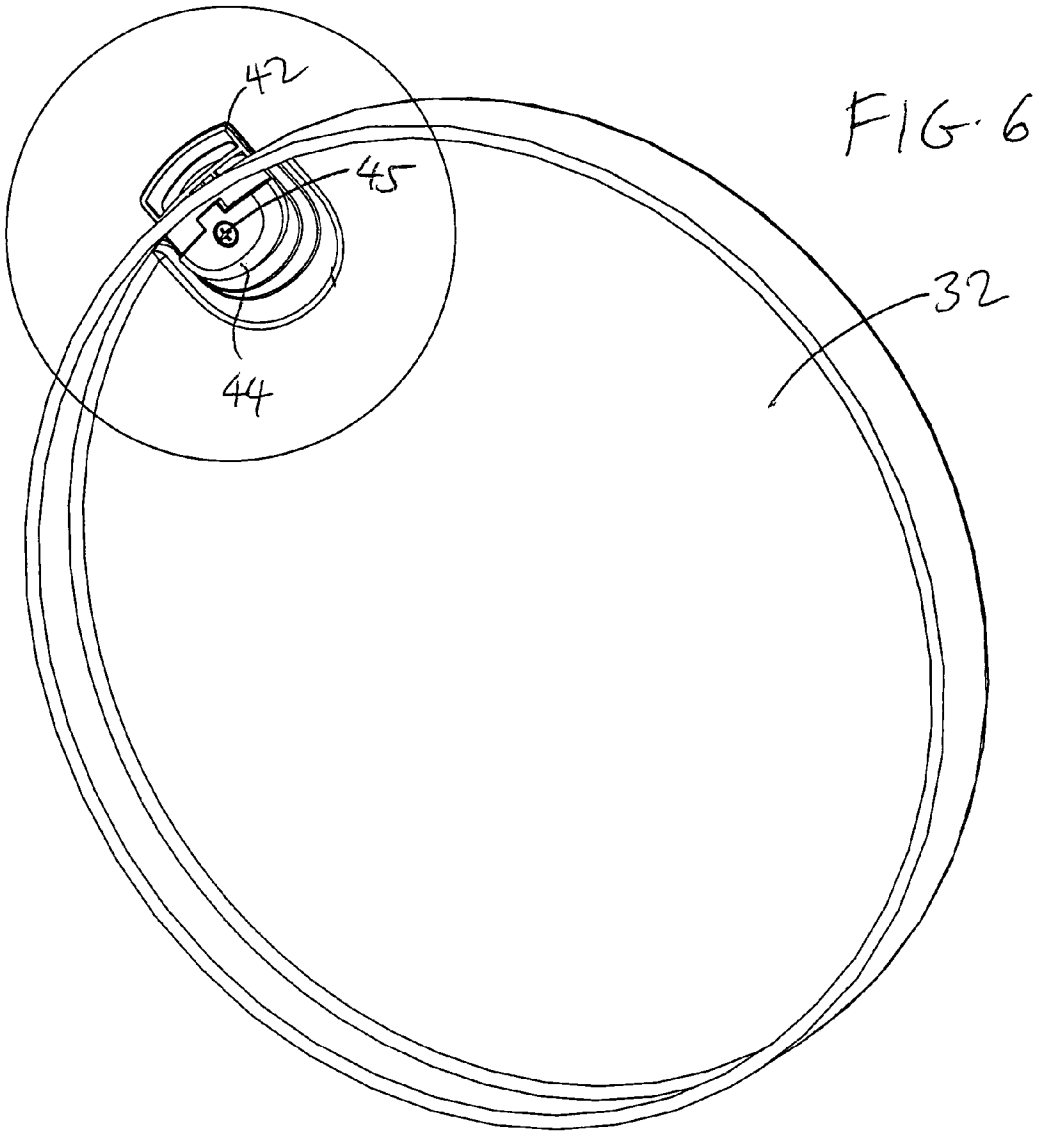
FIG. 6 is a bottom perspective view of the lid of the trash can assembly of FIG. 1.

The lock member 40 is adapted to experience reciprocal sliding motion between the locked position (FIGS. 4A and 5A) and the unlocked position (FIGS. 4B and 5B). The slide member 42 slides back and forth inside the depression 50. The upper frame support 28 is provided with an opening 30 that is adapted to receive the tongue 48 on the base member 44. To lock the lid 32, the user merely slides the slide member 42 towards the front of the lid 32, as shown in FIGS. 1, 4A and 5A. This causes the tongue 48 to be received inside and through the opening 30, so that the lid 32 is secured to the upper support frame 28. As best shown in FIG. 4A, the tongue 48 remains inside the confines of the shell 22 because there is a space 54 defined between the shell 22 and the upper support frame 28. To unlock the lid 32, the user merely slides the slide member 42 towards the rear of the lid 32, as shown in FIGS. 2, 4B and 5B. This causes the tongue 48 to be disengaged from the opening 30, so that the lid 32 is disengaged from the upper support frame 28.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having a base at a lower end of the shell and an outer side wall extending around a periphery of the trash can assembly, the outer side wall defining an interior, the shell further comprising a top end that defines a peripheral edge;

an upper support frame secured to the top end of the shell, the upper support frame extending around the peripheral edge of the top end of the shell, the upper support frame further comprising an opening configured to receive a tongue of a lock member;

a lid fitted over the top end, the lid being pivotally mounted relative to the shell so as to be pivotable between open and closed positions, the lid further comprising a top wall and an outer peripheral wall extending downwardly from a periphery of the top wall, the outer peripheral wall being sized such that the upper support frame is nested within the outer peripheral wall when the lid is in a closed position;

a pedal pivotally mounted to the base;

a link assembly connecting the pedal and the lid such that the pivoting motion of the pedal is transferred to the lid so as to move the lid from a closed position to an open position as the pedal is pivoted; and a lock member provided on the lid, the lock member having a slide member, a base member positioned below the slide member, the slide member and the base member being slidable relative to the lid between locked and unlocked positions, the lock member further comprising a tongue extending from the base member under the slide member, wherein the tongue is positioned to extend within the opening of the upper support frame when the slide member and the base member are in the locked position such that a single portion of the upper support frame is both located directly above the tongue and directly below the slide member so that the tongue and slide member form a sandwiched configuration around the portion of the upper support frame.

2. The assembly of claim 1, wherein the lid has a depression, with the lock member positioned inside the depression.

3. The assembly of claim 1, wherein the upper frame and the shell are provided in different materials.

4. The assembly of claim 3, wherein the upper support frame is plastic and the shell is a metal.

5. The assembly of claim 1 additionally comprising a liner retained within the shell, the liner made from a plastic material and having the same shape as the shell.

6. A trash can assembly, comprising:

a shell having an interior and a top end;

an upper support frame provided adjacent the top end of the shell and inside the interior of the shell, the upper support frame having at least one opening configured to receive a tongue of a lock member;

a lid fitted over the top end; and a lock member provided on the lid, the lock member having a tongue that is slidably moveable between locked and unlocked positions, wherein the tongue is disposed within the at least one opening when the tongue is in the locked position such that a single portion of the upper support frame is both located directly above the tongue and directly below a slide member of the lock member so that the tongue and slide member form a sandwiched configuration around the portion of the upper support frame, and wherein the tongue is spaced laterally away from the at least one opening when the tongue is in the unlocked position.

7. The assembly of claim 6, wherein the lid has a depression, with the lock member positioned inside the depression.

8. The assembly of claim 6, wherein a space is defined between the shell and the upper support frame.

9. The assembly of claim 6, wherein the lock member has a slide member, and a base member positioned below the slide member, with the tongue extending from the base member under the slide member.

10. The assembly of claim 6 additionally comprising a liner retained within the shell, the liner made from a plastic material and having the same shape as the shell.

11. The assembly of claim 6, wherein the upper support frame and the shell are provided in different materials.

12. The assembly of claim 11, wherein the upper support frame is plastic and the shell is a metal.

13. A trash can assembly, comprising:

a metal shell having an interior and a top end;

an upper support frame provided at the top end of the shell, the upper support frame formed of a plastic material and having at least one opening configured to receive a tongue of a lock member;

a lid fitted over the top end; and a lock member provided on the lid, the lock member having a tongue slidably mounted relative to the lid between locked and unlocked positions, the tongue positioned within the at least one opening when the tongue is in the locked position when the lid is closed such that a single portion of the upper support frame is both located directly above the tongue and directly below a slide member of the lock member so that the tongue and slide member form a sandwiched configuration around the portion of the upper support frame, the tongue being spaced laterally away from the at least one opening when the tongue is in the unlocked position and the lid is closed.

14. The assembly of claim 13, wherein the lid has a depression, with the lock member positioned inside the depression.

15. The assembly of claim 13, wherein a space is defined between the shell and the upper support frame.

16. The assembly of claim 13, wherein the lock member has a slide member, and a base member positioned below the slide member, with the tongue extending from the base member under the slide member.

17. The assembly of claim 13 additionally comprising a liner retained within the shell, the liner made from a plastic material and having the same shape as the shell.

* * * * *